US005088131A

United States Patent [19]

Kamata

[11] Patent Number: 5,088,131

[45] Date of Patent: Feb. 18, 1992

[54] HELMET WITH LOCKING PORTION FOR HOLDING SHIELD PLATE IN CLOSED POSITION

[75] Inventor: Eitaro Kamata, Tokyo, Japan

[73] Assignee: Shoei Kako Kabushiki Kaisha, Tokyo, Japan

[21] Appl. No.: 615,563

[22] Filed: Nov. 19, 1990

[30] Foreign Application Priority Data

Aug. 21, 1990 [JP] Japan ..... 2-87330[U]

[51] Int. Cl.[5] ..... A42B 1/08

[52] U.S. Cl. ..... 2/424

[58] Field of Search ..... 2/9, 410, 422, 424, 2/425

[56] References Cited

U.S. PATENT DOCUMENTS

| | | | |
|---|---|---|---|
| 3,858,242 | 1/1975 | Gooding | 2/424 |
| 3,945,043 | 3/1976 | DeAngelis | 2/424 |
| 4,138,746 | 2/1979 | Bergmann | 2/424 |
| 4,538,303 | 9/1985 | Schnitzler | 2/424 |
| 4,581,775 | 4/1986 | Nava | 2/424 |
| 4,884,302 | 12/1989 | Foehl | 2/424 |

FOREIGN PATENT DOCUMENTS

| | | | |
|---|---|---|---|
| 1-87123 | 6/1989 | Japan . | |
| 2061696 | 5/1981 | United Kingdom | 2/410 |
| 2103467 | 2/1983 | United Kingdom | 2/410 |

*Primary Examiner*—Werner H. Schroeder
*Assistant Examiner*—Michael A. Neas
*Attorney, Agent, or Firm*—Armstrong, Nikaido, Marmelstein, Kubovcik & Murray

[57] ABSTRACT

A helmet according to the present invention incorporates an engaging projection inwardly projected from at least one of the right and left side lower portions of a shield plate, an edge member closely contacted with an inner surface of the shield plate in a closing position thereof, and a locking portion capable of engaging with the engaging projection when the shield plate is in the closing position. The engagement of the engaging projection with the locking portion is released when the shield plate is elastically deflected. The shield plate can thus be held at the closing position with such a simple structure thereby reducing the number of components.

4 Claims, 5 Drawing Sheets

HELMET WITH LOCKING PORTION FOR HOLDING SHIELD PLATE IN CLOSED POSITION

BACKGROUND OF THE INVENTION

1. Field of the Invention

The present invention relates to a helmet comprising a cap body, a shield plate formed of a synthetic resin having elasticity and supported on both sidewalls of the cap body so as to open or close a window defined in a front of the cap body, and an edge member provided on a cap body at an edge of the window for closely contacting with an inner surface of the shield plate in a closing position thereof.

2. Description of the Prior Art

There is conventionally known a helmet of the above type, for example, as disclosed in Japanese Utility Model Laid-Open No. 1-87123 (87123/89).

When a wearer of a helmet is travelling on a motorcycle in a state that a shield plate is in a closing position thereof, the plate may be vibrated or driven by a travelling wind blowing from below the shield plate and be turned in an opening direction thereof. In the conventional helmet, an enlarged portion is formed at a side edge of the shield plate, and a clamping member having an engaging projection to be engaged with the enlarged portion is secured to an outer surface of a cap body. Thus, the side edge of the shield plate is clamped between the clamping member and the cap body while engaging the engaging projection with the enlarged portion of the shield plate in the closing position to prevent the shield plate from being driven by the travelling wind and turned in the opening direction. However, according to such construction, it is necessary to fixedly arrange the clamping member on the outer surface of the cap body, resulting in increase in number of components and deterioration in an external appearance.

SUMMARY OF THE INVENTION

The present invention has been accomplished with such circumstances in view, and it is an object of the present invention to provide a helmet of the type described above, in which a shield plate can be held at the closing position in a simple structure while reducing the number of components.

According to the present invention, there is provided a helmet comprising a cap body, a shield plate formed of a synthetic resin having flexibility and supported on opposite sidewalls of the cap body so as to open or close a window in a front surface of the cap body, and an edge member provided on the cap body at an edge of the window for close contact with an inner surface of the shield plate in a closing position thereof, the shield plate being provided at least at one of right and left side lower portions thereof with an engaging projection projected inwardly of the shield plate, the edge member being integrally and projectingly provided with a locking portion for engaging with the engaging projection in a state where the shield plate is in the closing position, the locking portion passing over the engaging projection when the shield plate is slightly turned from the closing position toward an opening side.

With such a construction, when the shield plate is brought to the closing position, the engaging projection of the shield plate is elastically engaged with the locking portion. When the shield plate is turned from the closing position to the opening side, the shield plate must be deflected so that the engaging projection passes over the locking projection. Thus, the shield plate can be held at its closing position unless a forcible external force is applied to deflect the shield plate and the shield plate can be prevented from being turned in an opening direction thereof by the blast of travelling wind or a vibration. Further, the locking portion is hidden by the side edge of the shield plate when the plate is in its closing position to provide an excellent external appearance. Moreover, the locking portion is integrally formed with the edge member, which does not increase the number of components.

These and other objects and features of the present invention will become apparent from the following detailed description in conjunction with the attached drawings.

DESCRIPTION OF THE PREFERRED EMBODIMENT

The present invention will now be described by way of one embodiment with reference to the accompanying drawings.

Figure 1:
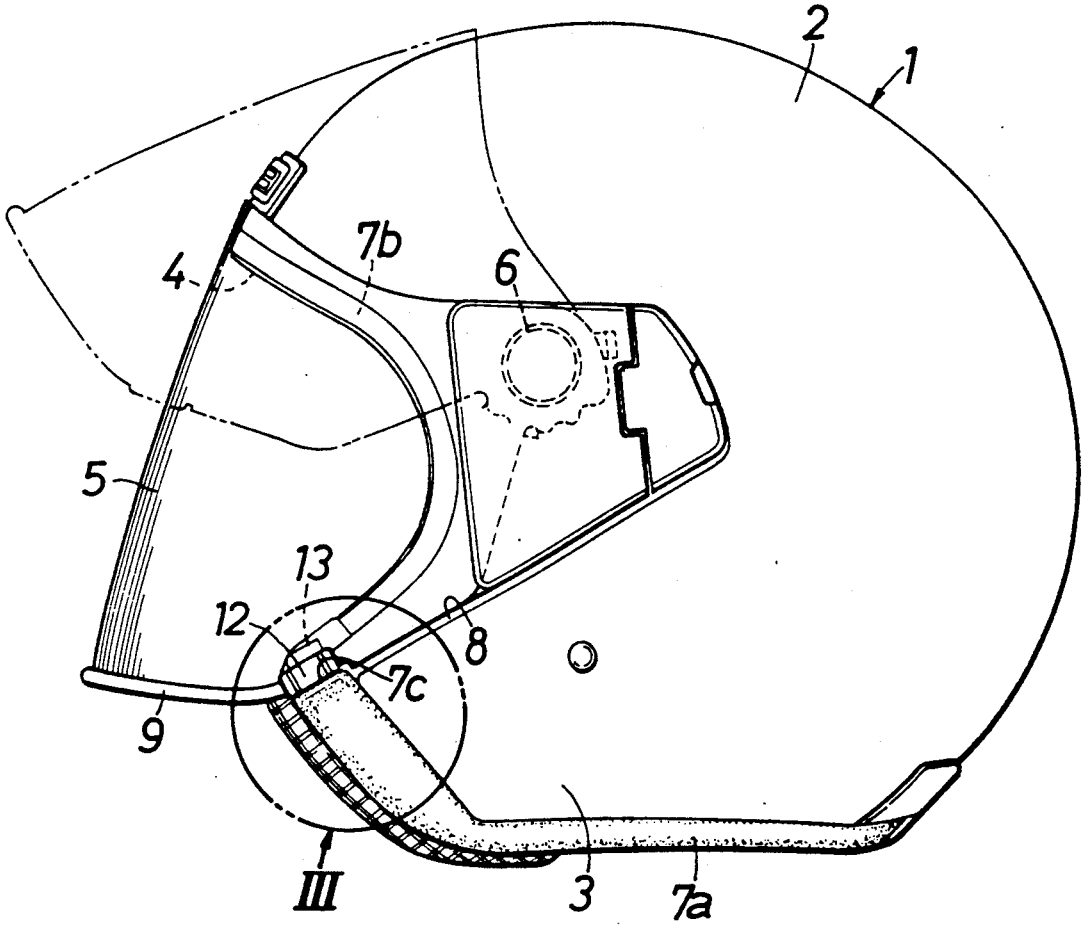
FIG. 1 is a side view of an embodiment of a helmet for a motorcycle according to the present invention.
Figure 2:
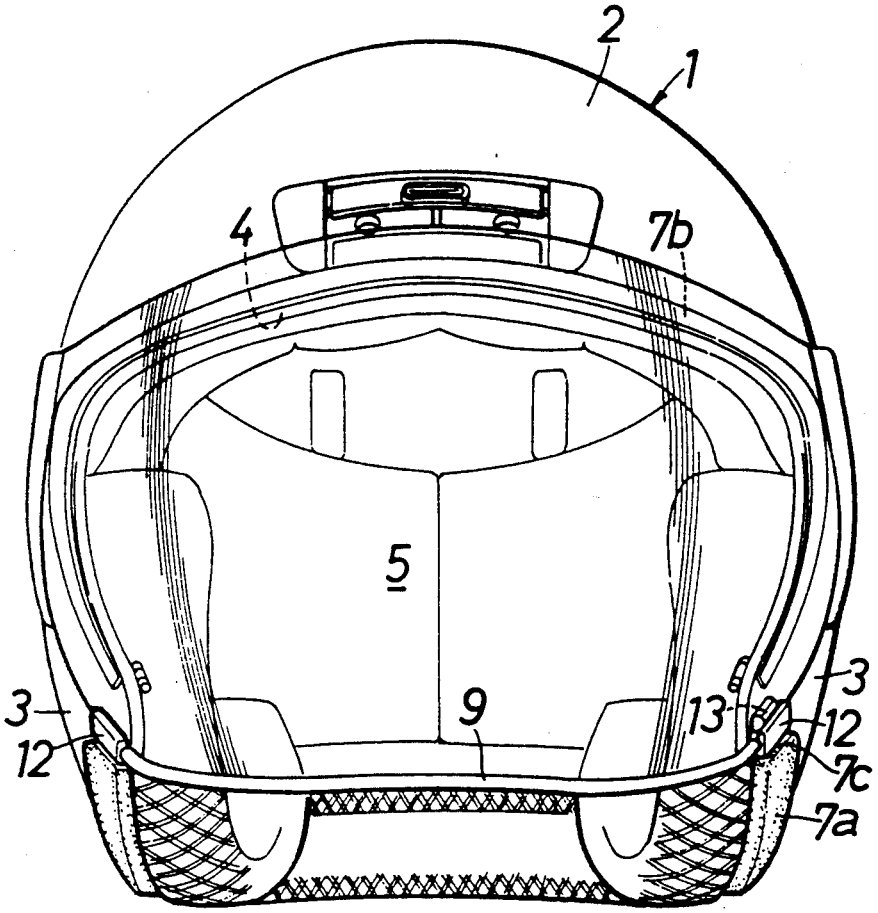
FIG. 2 is a front view of the helmet.

Referring to FIGS. 1 and 2, a cap body 1 of a jet type helmet for a motorcycle is formed by fitting a buffer liner (not shown) made of a styrene foam into a shell 2 made of a hard high strength resin as outer shell. The cap body 1 is integrally and continuously provided with a pair of left and right ear cover portions 3 extending downward so as to cover around the ears of a wearer of the helmet. A window 4 for exposing the user's face is defined in a front of the cap body 1 between both the left and right ear cover portions 3. A shield plate 5 made of a transparent synthetic resin having elasticity is pivotally secured at both ends thereof to both sidewalls of the cap body 1 at both sides of the window 4 through pivotal shafts 6 for turning between a closing position for covering the window 4 (a position indicated by a solid line in FIG. 1) and an opening position for opening the window 4 (a position indicated by a dotted broken line in FIG. 1).

Figure 3:
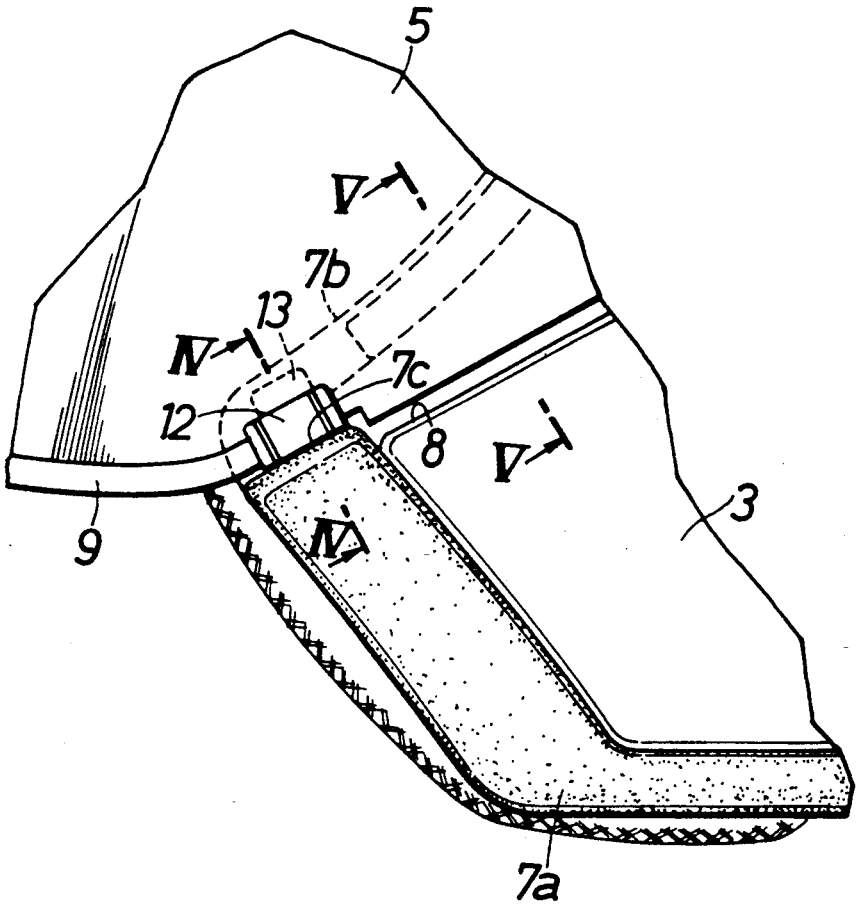
FIG. 3 is an enlarged view of a portion indicated by an arrow III in FIG. 1.
Figure 4:
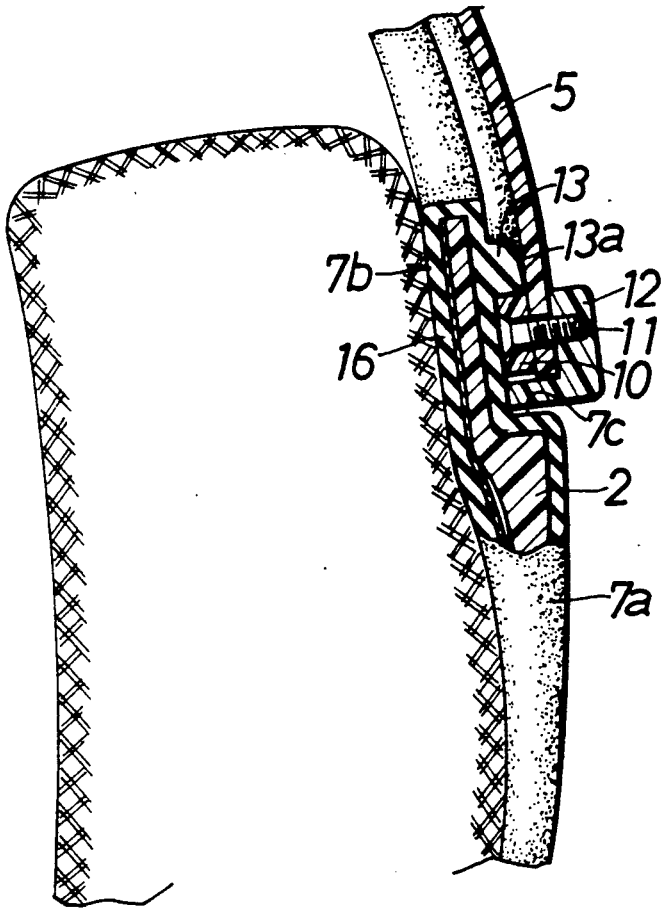
FIG. 4 is a sectional view taken along the line IV—IV in FIG. 3.
Figure 5:
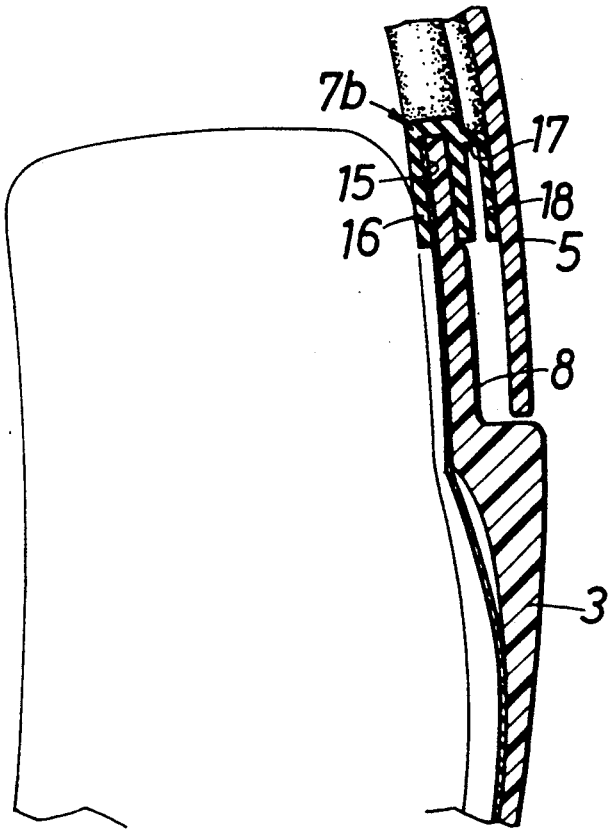
FIG. 5 is a sectional view taken along the line V—V in FIG. 3.

Referring also to FIGS. 3, 4 and 5, an edge member 7*a* made of an elastic material such as rubber, etc. is adhesively fitted to the lower edge of the shell 2 of the cap body 1. An edge member 7*b* integral with the edge member 7*a* is adhesively fitted to the edge of the window 4. The edge member 7*b* comprises a body portion 16 of a U-shaped section forming a mounting groove 15 for adhesively fitting to the shell 3 at the edge of the window 4, and a seal lip portion 18 continuously provided with the body portion 16 and forming a drain groove 17 opened upwardly and outwardly between an outer surface of the body portion 16 and the seal lip portion 18. The shield plate 5 is brought into contact with the seal lip portion 18 at its closing position, and the seal lip portion 18 is elastically brought into close contact with the inner surface of the shield plate 5. The drain groove 17 serves to prevent rainwater flowing down on the outer surface of the cap body 1 from entering into the window 4.

A depression 8 is formed on the shell 2 at the peripheral edge portion of the window 4 for placing the outer surface of the shield plate 5 into a position substantially flush with the outer surface of the shell 2 in a state where the shield plate 5 is closely contacted with the edge member *7b*. A step *7c* is provided on the connecting portion of the edge members *7a* and *7b* at the lower end of the window 4.

A beading 9 is provided on the lower edge of the shield plate 5. A synthetic resin piece having a relatively high rigidity is attached to an inner surface of the shield plate 4 on both sides at each of the opposite ends of the beading 9 so as to form an engaging projection 10 slightly projected inwardly from the inner surface of the shield plate 5 by a screw member 11. In addition to the synthetic resin piece, another synthetic resin piece is attached by the screw member 11 on the outer surfaces of the lower portions of opposite sides of the shield plate 5. Thus, a stopper 12 bent from the outer surface of the shield plate 5 to the edge side is formed at each of the outer surfaces of the lower portions of opposite sides of the shield plate 5.

On the other hand, a locking portion 13 to be elastically engaged with the engaging projection 10 is integrally projected, on the wearer's left hand sides from the lower end of the edge member *7b*, which is fitted to the edge of the window 4. The locking portion 13 is adapted to be passed over by the engaging projection 10 while the shield plate 5 is turned finely or slightly from the closing position to the opening position of the shield plate 5. Further, the tip end face 13*a* of the locking portion 13 is formed into a slant with a rear portion higher in height.

The operation of this embodiment will now be described hereinafter.

If the shield plate 5 is turned from its opening position toward its closing position, the engaging projection 10 of the left side lower portion of the shield plate 5 with the locking portion 13 at a predetermined position where the window 4 is still slightly opened. Then, if the shield plate 5 is further turned toward the closing position until the plate 5 is closely contacted with the edge member *7b* such that the engaging projection 10 passes over the locking portion 13 while plastically deflecting the shield plate 5, the engaging projection 10 is elastically engaged with the locking portion 13. In this case, since the end face 13*a* of the connecting portion 13 is formed into a slant with a rear portion thereof higher in height, the engaging projection 10 can relatively smoothly pass over the locking portion 13.

Since the left and right stoppers 12 strikes the step *7c* of the connecting portions of the edge members *7a* and *7b* when the shield plate 5 is turned to its closing position, even if the shield plate 5 is abruptly turned to the closing position, the side edges of the shield plate 5 can be avoided to be impactly collided against the stepped portions of the recesses 8, thereby preventing the side edges of the shield plate 5 and the surface of the cap body 1 from being damaged.

Assuming that the wearer of the helmet is travelling on a motorcycle with the shield plate 5 elastically engaged with the edge member *7b*, the elastic engagement of the engaging projection 10 with the locking portion 13 is not released unless an external force for deflecting and expanding the shield plate 5 is applied to the shield plate 5. Thus, the shield plate 5 is reliably prevented from being turned to its opening position due to a blast of travelling wind or vibration.

When the wearer wants to turn the shield plate to its opening position, the wearer may grasp the side edge of the left side lower portion of the shield plate 5 and deflects the shield plate 5 to release the engaging state, thereby enabling the engaging portion 10 to pass over the locking portion. Then, the shield plate 5 can be turned to its opening position.

In the embodiment described above, the locking portion 13 is provided only at the left side of the edge member *7b* so that the driver of the motorcycle operates the shield plate 5 only with his left hand which is free from an accelerator operation during travelling of the motorcycle, thereby improving the operatability. However, it may, of course, provide the locking portions 13 at both right and left sides.

The present invention may be applied not only to the jet type helmet as in the embodiment described above, but also to a full-face type helmet.

What is claimed is:

1. A helmet comprising:

a cap body; and a shield plate formed of a synthetic resin having elasticity and supported on opposite sidewalls of said cap body so as to open or close a window defined in a front of said cap body, an edge member provided on said cap body at an edge of the window for close contact with an inner surface of said shield plate in a closing position thereof, said shield plate being provided at least at one of right and left side lower portions thereof with an engaging projection projected inwardly of the shield plate, the edge member being integrally and projectingly provided with a locking portion for engaging with the engaging projection so as to retain said shield plate in the closing position, the engagement of the engaging projection with the locking portion being released when the shield plate is deflected elastically.

2. A helmet according to claim 1, wherein a tip end face of the locking portion is formed into an oblique surface which the engaging projection can ascend while permitting said shield plate to flex when said shield plate is turned from the opening side to the closing position.

3. A helmet according to claim 1, said helmet further comprising:

a depression formed at a peripheral edge of the window of said cap body for placing an outer surface of said shield plate into a position substantially flush with an outer surface of said cap body when said shield plate is closed;

a stepped portion continuously formed with said depression and extended from the edge member so as to oppose the locking portion of the edge member; and a stopper extended from an outer surface of said shield plate to at least one of the left and right edge side lower portions of said shield plate in a bent fashion so as to be received, together with the engaging projection of said shield plate, between the locking portion and the stepped portion when said shield plate is closed.

4. A helmet according to claim 1, 2 or 3, wherein the locking portion is formed only at one side of the edge member so that a wearer of the helmet can operate said shield plate with only one hand.

* * * * *